US007588648B2

(12) United States Patent
Toyoda et al.

(10) Patent No.: US 7,588,648 B2
(45) Date of Patent: Sep. 15, 2009

(54) SOFT MAGNETISM MATERIAL AND POWDER MAGNETIC CORE

(75) Inventors: Haruhisa Toyoda, Itami (JP); Hirokazu Kugai, Itami (JP); Kazuhiro Hirose, Itami (JP); Naoto Igarashi, Itami (JP); Takao Nishioka, Itami (JP)

(73) Assignee: Sumitomo Electric Industries, Inc., Osaka (JP)

( * ) Notice: Subject to any disclaimer, the term of this patent is extended or adjusted under 35 U.S.C. 154(b) by 454 days.

(21) Appl. No.: 10/549,964

(22) PCT Filed: Oct. 7, 2004

(86) PCT No.: PCT/JP2004/015208

§ 371 (c)(1),
(2), (4) Date: Sep. 16, 2005

(87) PCT Pub. No.: WO2005/038830

PCT Pub. Date: Apr. 28, 2005

(65) Prior Publication Data

US 2006/0216507 A1 Sep. 28, 2006

(30) Foreign Application Priority Data

Oct. 15, 2003 (JP) ..... 2003-354940

(51) Int. Cl.
*H01F 1/20* (2006.01)

(52) U.S. Cl. ..... 148/306; 148/309

(58) Field of Classification Search ..... None
See application file for complete search history.

(56) References Cited

U.S. PATENT DOCUMENTS

| | | | | |
|---|---|---|---|---|
| 4,257,830 | A * | 3/1981 | Tsuya et al. | 148/112 |
| 5,474,624 | A * | 12/1995 | Suzuki et al. | 148/121 |
| 5,741,373 | A * | 4/1998 | Suzuki et al. | 148/306 |
| 5,800,636 | A * | 9/1998 | Tsukada et al. | 148/306 |
| 6,638,335 | B2 * | 10/2003 | Ozaki et al. | 75/255 |
| 2005/0012652 | A1 * | 1/2005 | Wakayama et al. | 342/1 |

FOREIGN PATENT DOCUMENTS

| | | | |
|---|---|---|---|
| JP | 06-181113 | A | 6/1994 |
| JP | 07-201549 | A | 8/1995 |
| JP | 08-037107 | A | 2/1996 |
| JP | 2000-017336 | A | 1/2000 |
| JP | 2001-68323 | A | 3/2001 |

(Continued)

OTHER PUBLICATIONS

PCT International Preliminary Report on Patentability for PCT/JP2004/015208 issued on Jun. 26, 2006.

(Continued)

*Primary Examiner*—John P. Sheehan
(74) *Attorney, Agent, or Firm*—Darby & Darby PC

(57) ABSTRACT

The present invention provides a soft magnetic material and a powder magnetic core having desired magnetic characteristics.

A soft magnetic material contains a metal magnetic powder 10. The metal magnetic powder 10 is formed from crystals 1 with an average size, as determined from X-ray diffraction, of at least 30 nm. It would be preferable, in the metal magnetic particles 10, for crystal grains 2 to have an average size of at least 10 microns.

7 Claims, 2 Drawing Sheets

FOREIGN PATENT DOCUMENTS

| | | | |
|---|---|---|---|
| JP | 2001-307914 | A | 11/2001 |
| JP | 2002-121601 | A | 4/2002 |
| JP | 2002-246219 | A | 8/2002 |
| JP | 2004-288941 | * | 10/2004 |

OTHER PUBLICATIONS

Patent Abstracts of Japan for JP08-037107 published Feb. 6, 1996.
Patent Abstracts of Japan for JP06-181113 published Jun. 28, 1994.
Patent Abstracts of Japan for JP2001-068323 published Mar. 16, 2001.
Patent Abstracts of Japan for JP07-201549 published Aug. 4, 1995.
Patent Abstracts of Japan for JP2002-246219 published Aug. 30, 2002.
Patent Abstracts of Japan for JP2001-307914 published Nov. 2, 2001.
Patent Abstracts of Japan for JP2000-017336 published Jan. 18, 2000.
Patent Abstracts of Japan for JP2002-121601 published Apr. 26, 2002.
International Search Report for PCT/JP2004/015208 mailed Nov. 30, 2004.

* cited by examiner

SOFT MAGNETISM MATERIAL AND POWDER MAGNETIC CORE

CROSS-REFERENCE TO PRIOR APPLICATION

This is a U.S. National Phase application under 35 U.S.C. §371 of International Patent Application No. PCT/JP2004/015208 filed Oct. 7, 2004, and claims the benefit of Japanese Patent Application No. 2003-354940 filed Oct. 15, 2003 both of which are incorporated by reference herein. The International Application was published in Japanese on Apr. 28, 2005 as WO 2005/038830 A1 under PCT Article 21(2).

1. Technical Field

The present invention relates generally to a soft magnetism material and a dust core. More specifically, the present invention relates to a soft magnetism material and dust core containing metal magnetic particles.

2. Background Art

Conventionally, higher densities and compact designs are demanded of electrical parts such as motor cores and transformer cores. Also, there is a demand for allowing more precise control to be performed with low power. For these reasons, development has been taking place for soft magnetism material that are used in producing these electrical parts and, more specifically, that have superior magnetic characteristics in the medium- and high-frequency range.

An example of this type of soft magnetism material is presented in Japanese Laid-Open Patent Publication Number 2002-121601, which discloses soft magnetism metal powder particles for the purpose of increasing permeability. In the soft magnetism metal powder particles described in Japanese Laid-Open Patent Publication Number 2002-121601, the particles are formed so that there is an average of no more than 10 crystal grains on a cross-section surface of an individual soft magnetism metal powder particle.

Various particle diameters are used for the soft magnetism metal powder particles, as can be seen in the description in Japanese Laid-Open Patent Publication Number 2002-121601, which states that a range of 10 microns-1000 microns would be preferable for the particle diameter of the soft magnetism metal powder particles. If the number of crystal grains are defined as described above, the size of the crystal grains will change when the diameter of the soft magnetism metal powder particle changes. Also, when the crystal grain size changes, the number per unit length of crystal grain boundaries present at the boundaries between crystal grains will change as well. In other words, the number of crystal grain boundaries per unit length decreases for larger soft magnetism metal powder particle diameters, and the number of crystal boundaries per unit length will increase for smaller soft magnetism metal powder particles.

Since permeability is reduced when magnetic flux passes through a crystal grain boundary, however, the number of crystal grain boundaries per unit length is a factor in permeability. Thus, it is not possible to always provide desired magnetic characteristics with the soft magnetism metal powder particles disclosed in Japanese Laid-Open Patent Publication Number 2002-121601, where the number of crystal grain boundaries changes according to particle diameter.

Also, magnetic characteristics such as permeability are affected by distortion (dislocations, defects) present in the soft magnetism metal powder particles. For this reason, desired magnetic characteristics cannot be obtained solely by controlling crystal grains based on observation with optical microscopes and scanning ion microscopes.

DISCLOSURE OF INVENTION

The object of the present invention is to overcome the problems described above and to provide a soft magnetism material and powdered core that have desired magnetic characteristics.

A soft magnetic material according to the present invention includes: a metal magnetic powder, the metal magnetic powder being formed from crystals having an average size, as determined by X-ray diffraction, of at least 30 nm.

A metal magnetic particle made from polycrystal is formed as a collection of multiple crystal grains each of which forms a single region bound by a grain boundary and, when looking at a crystal axis, the orientations are all identical at any section of the single region. Also, stated another way, in a metal magnetic particle, a single region is defined by X-ray diffraction and is formed by a collection of multiple crystals, which are the largest aggregates that can be considered single crystals of microcrystals. A single region of a crystal is smaller than a single region of a crystal grain, and a single crystal grain contains multiple crystals. In the present invention, the average crystal size is at least 30 nm.

By having the average size of the crystals forming the metal magnetic powder in the soft magnetic material described above be at least 30 nm, distortion (dislocations, defects) present within the metal magnetic particles can be reduced. As a result, the problems of domain wall displacement (magnetic flux changes) due to distortion can be limited, thus providing a soft magnetic material having a high permeability.

It would be preferable, in the metal magnetic particle, for an average size of a crystal to be at least 60 nm. It would be more preferable for the average crystal size to be at least 80 nm. This would achieve a soft magnetic material with an even higher permeability.

It would be preferable, in the metal magnetic particle, for an average size of a crystal grain to be at least 10 microns. With a soft magnetic material having this structure, the number of times per unit length that magnetic flux would pass through a crystal grain boundary can be reduced. This would achieve a soft magnetic material with an even higher permeability.

It would be preferable for the soft magnetic material to further include a plurality of compound magnetic particles including the metal magnetic particles and an insulative film surrounding a surface of the metal magnetic particles. With a soft magnetic material having this structure, providing the insulative film can restrict the flow of eddy currents between metal magnetic particles. This would reduce iron loss in the soft magnetic material caused by eddy currents.

It would be preferable for the soft magnetic material to further include an organic matter bonding the plurality of compound magnetic particles to each other. With a soft magnetic material having this structure, the organic matter between the plurality of compound magnetic particles acts as a lubricant. This prevents destruction of the insulative film during pressure-forming of the soft magnetic material.

A powder magnetic core according to the present invention is made using a soft magnetic material as described any of the above. With a powder magnetic core having this structure, a high permeability can be achieved and the advantages described above are provided. Of course, with a high permeability, magnetic coercive force can be reduced and iron loss (especially hysteresis loss) can be reduced.

BEST MODE FOR CARRYING OUT THE INVENTION

An embodiment of the present invention will be described, with references to the drawings.

Figure 1:
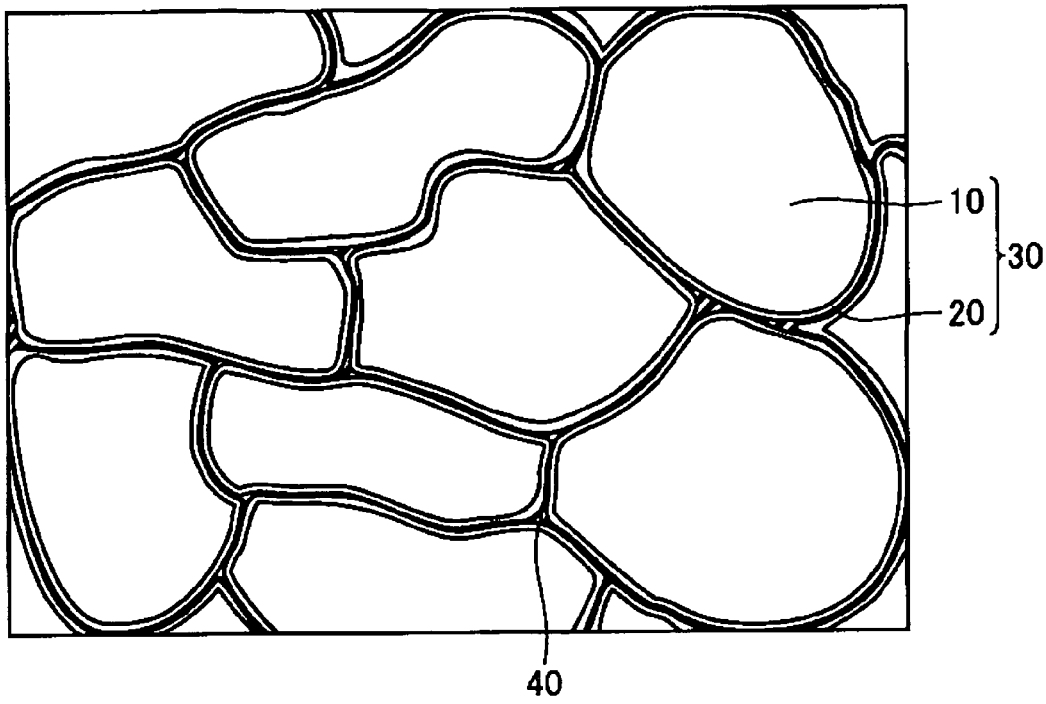
FIG. 1 is a simplified drawing showing a soft magnetic material according to an embodiment of the present invention.

FIG. 1 is a simplified diagram showing a soft magnetic material according to an embodiment of the present invention. As shown in FIG. 1, the soft magnetic material includes multiple compound magnetic particles 30 formed from a metal magnetic particle 10 and an insulative film 20 surrounding the surface of the metal magnetic particle 10. An organic matter 40 is interposed between the compound magnetic particles 30. The compound magnetic particles 30 are bonded by the organic matter 40 and are bonded by the engagement of the concavities and projections of the multiple compound magnetic particles 30.

Examples of materials that can be used to form the metal magnetic particles 10 include: iron (Fe), an iron (Fr)-silicon (Si)-based alloy, an iron (Fe)-nitrogen (N)-based alloy, an iron (Fe)-nickel (Ni)-based alloy, an iron (Fe)-carbon (C)-based alloy, an iron (Fe)-boron (B)-based alloy, an iron (Fe)-cobalt (Co)-based alloy, an iron (Fe)-phosphorous (P)-based alloy, an iron (Fe)-nickel (Ni)-cobalt (Co)-based alloy, and iron (Fe)-aluminum (Al)-silicon (Si)-based alloy. The metal magnetic particles 10 can be a single metal or an alloy.

It would be preferable for the average particle diameter of the metal magnetic particles 10 to be at least 5 microns and no more than 300 microns. If the average particle diameter of the metal magnetic particles 10 is set to at least 5 microns, the metal tends to not oxidize, thus improving the magnetic characteristics of the soft magnetic material. Also, by having the average particle diameter of the metal magnetic particles 10 be no more than 300 microns, it is possible to prevent reduction of compressibility of the mixed powder in the shaping step described later. As a result, a high density can be achieved for the shaped body obtained from the shaping step.

The average particle diameter referred to here is the diameter of the particle for which the sum of the masses of the particles having smaller particle diameters is 50% of the total mass when using a histogram of particle diameters measured using a sieve method, i.e., a 50% particle diameter D.

The insulative film 20 is formed by processing the metal magnetic particles 10 with phosphoric acid. Preferably, the insulative film 20 contains an oxide. For the insulative film 20 containing an oxide, it is possible to use, besides ferric phosphate, which contains phosphorous and iron, an oxide insulator such as manganese phosphate, zinc phosphate, calcium phosphate, silicon oxide, titanium oxide, aluminum oxide, or zirconium oxide.

The insulative film 20 serves as an insulation layer between the metal magnetic particles 10. By covering the metal magnetic particles 10 with the insulative film 20, the resistivity ρ of the soft magnetic material can be increased. As a result, the flow of eddy-currents between the metal magnetic particles 10 can be restricted and iron loss in the soft magnetic material caused by the eddy currents can be reduced.

It would be preferable for the insulative film 20 to have a thickness of at least 0.005 microns and no more than 20 microns. By having the thickness of the insulative film 20 be at least 0.005 microns, energy loss due to eddy currents can be restricted. Also, by making the thickness of the insulative film 20 be no more than 20 microns, it is possible to prevent the proportion of the insulative film 20 in the soft magnetic material from being too large. Thus, significant reduction in the magnetic flux density in the soft magnetic material can be prevented.

The organic matter 40 can be: a thermoplastic resin such as thermoplastic polyimide, a thermoplastic polyamide, a thermoplastic polyamide-imide, polyphenyl sulfide, polyamide-imide, polyether sulfone, polyetherimide, or polyether ether ketone; a non-thermoplastic resin such as a fully aromatic polyester or a fully aromatic polyimide; or a higher fatty acid such as zinc stearate, lithium stearate, calcium stearate, lithium palmitate, calcium palmitate, lithium oleate, or calcium oleate. Also, combinations of these can be used as well.

It would be preferable for the proportion of the organic matter 40 relative to the soft magnetic material to exceed 0 and to be no more than 1.0 percent by mass. By making the proportion of the organic matter 40 be no more than 1.0 percent by mass, it is possible to have the proportion of the metal magnetic particles 10 in the soft magnetic material to be at least a fixed amount. As a result, a soft magnetic material with a higher magnetic flux density can be obtained.

Figure 2:
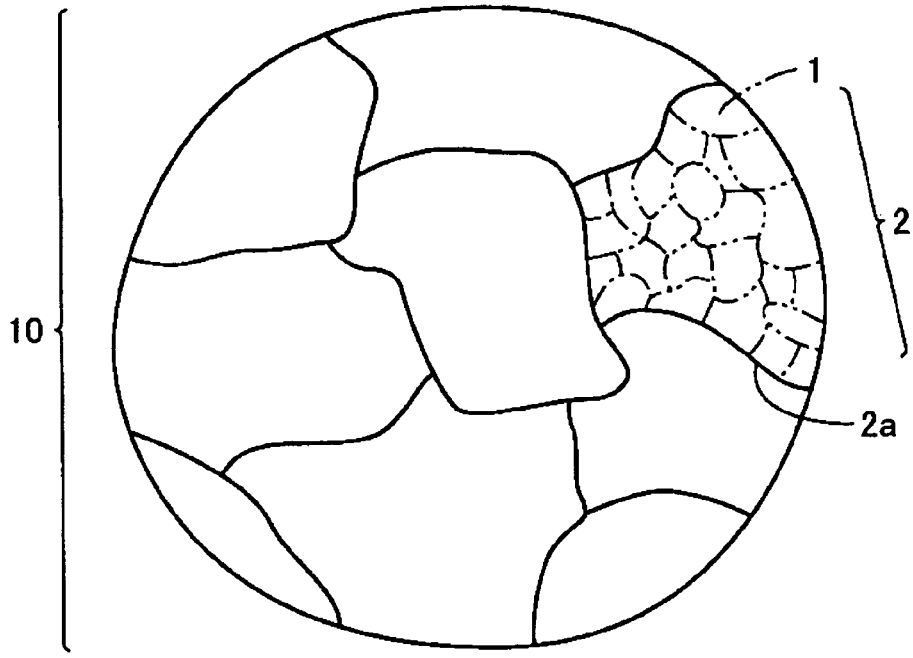
FIG. 2 is a simplified drawing showing a detail of the surface of a metal magnetic particle shown in FIG. 1.

FIG. 2 is a simplified diagram that shows a detail view of the surface of metal magnetic particles from FIG. 1. As shown in FIG. 2, the metal magnetic particle 10 is formed as a polycrystal made up of a collection of multiple crystal grains 2. Crystal grain boundaries 2*a* are extended on the boundaries of the crystal grains 2. From another perspective, it could be said that the metal magnetic particles 10 are formed as a collection of multiple crystals 1. A single region defined by a crystal 1 is smaller than a single region of a crystal structure defined by the crystal grain 2. For convenience, in FIG. 2, the crystals 1 are shown for a single crystal grain 2.

The average size of the crystals 1 is at least 30 nm. As a result, distortions (dislocations, defects) present within the metal magnetic particles 10 can be reduced. The average size of the crystals 1 is a value determined using X-ray diffraction. For example, the method described next can be used.

Figure 3:
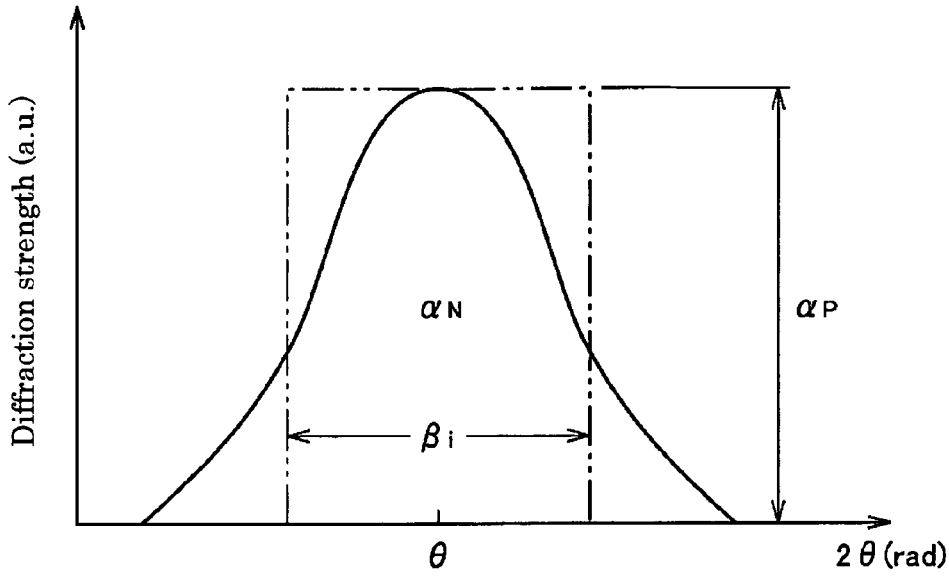
FIG. 3 is a graph showing a diffraction strength profile obtained when an X-ray is applied to metal magnetic particles.

FIG. 3 is a graph that shows the profile of diffraction strength obtained when an X-ray is applied to metal magnetic particles. Referring to FIG. 3, when an X-ray is applied to metal magnetic particles 10, a peak with a strength $\alpha_p$ at the Bragg angle θ having a predetermined spread on either side of the Bragg angle θ is measured. An integral strength $\alpha_N$ is determined from the area of this peak. An integral width $\beta_i$ is calculated by dividing the strength $\alpha_N$ by the peak strength $\alpha_p$.

When the X-ray applied to the metal magnetic particle 10 has a wavelength of λ, an average size d of the crystals 1 is determined by substituting the values of the Bragg angle θ, the peak integral with $\beta_i$ (radians), and the wavelength λ into the following Scherrer equation.

$$d=\lambda/(\beta_i \cos\theta)$$

The Scherrer equation can be applied when the value of d is in a range from approximately 1 nm to approximately 100 nm. Besides the Scherrer equation, it would also be possible to use the Hall method, which determines the average size d of the crystals 1 by measuring at least two peak strength samples.

Referring to FIG. 2, it would be preferable for the average size of the crystal grains 2 to be at least 10 microns. This makes it possible to reduce the number per unit length of crystal grain boundaries 2*a*, thus providing a high permeability. The average size of the crystal grains 2 can be determined by using an optical microscope or a scanning ion microscope to measure the sizes of multiple crystal grains 2 and to average the obtained measurements.

The soft magnetic material in this embodiment includes the metal magnetic particles 10. In the metal magnetic particles 10, the average size of the crystals 1 determined by X-ray diffraction is at least 30 nm. It would be preferable for the average size of the crystal grains 2 in the metal magnetic particles 10 to be at least 10 microns.

Next, a method for making the soft magnetic material shown in FIG. 1 will be described. First, metal magnetic particles 10 are prepared, and these metal magnetic particles 10 are heat-treated. The temperature for this treatment can be, for example, at least 100 deg C. and no more than 1000 deg C., and the treatment time can be, for example, at least 1 hour. Then, the insulative films 20 are formed on the surfaces of the metal magnetic particles 10, resulting in compound magnetic particles 30.

Next, the compound magnetic particles 30 and the organic matter 40 are mixed together, resulting in a mixed powder. There are no special restrictions on the method used for mixing. Examples include mechanical ironing, vibrating ball mill, planetary ball mill, mechanofusion, coprecipitation, chemical vapor deposition, physical vapor deposition, plating, sputtering, vapor deposition, a sol-gel method, or the like.

Next, the obtained mixed powder is placed in a die and pressurized to a pressure of, e.g., 700 MPa to 1500 MPa. This provides a shaped body in which the mixed powder is compressed. It would be preferable for the pressurizing and shaping atmosphere to be a decompression atmosphere or an inert-gas atmosphere. In this case, it would be possible to restrict the oxidation of the mixed powder resulting from oxygen in the atmosphere.

In the case of pressure-forming the organic matter 40 acts as a buffer between the compound magnetic particles 30. As a result, the destruction of the insulative film 20 from contact between the compound magnetic particles 30 is prevented.

Next, the shaped body obtained by pressurizing and shaping is heated, e.g., for 1 hour at a temperature of at least 200 deg C. and no more than the thermal decomposition temperature of the insulative film 20. By performing heat treatment on the metal magnetic particles 10 in the shaped body twice, it is possible to control the size of the crystals 1 of the metal magnetic particles 10 to be at least 30 nm. The shaped body shown in FIG. 1 is completed with the steps described above.

With the soft magnetic material formed in this manner, it is possible to reduce distortion in the metal magnetic particles 10 by having the average size of the crystals 1 of the metal magnetic particles 10 be at least 30 nm. This makes it possible to improve permeability of the soft magnetic material. Also, by having the average size of the crystal grains 2 of the metal magnetic particles 10 be at least 10 microns, a synergistic effect is provided that significantly improves the permeability of the soft magnetic material.

The soft magnetic material of this embodiment can be used in electrical parts such as choke coils, switching power supply elements, and magnetic heads, various types of motor parts, automotive solenoids, various types of magnetic sensors, and various types of electromagnetic valves.

WORKING EXAMPLES

The soft magnetic material of the present invention was evaluated based on the embodiment described above. The soft magnetic material shown in FIG. 1 was made according to the method described for the embodiment. In this case, an atomized iron powder with a purity of at least 99.8% was used. In this working example, multiple types of raw iron powder was used, e.g., the product "ASC100.29" from Hoganas. The crystal grains had different sizes depending on the conditions under which they were atomized when the raw iron powder was made. In this working example, raw iron powder with average crystal grain sizes of 5 microns, 10 microns, and 20 microns were used. The metal magnetic particles 10 were heated at predetermined temperature conditions. The heat-treatment was performed for 1 hour in hydrogen or an inert gas.

Then, a phosphate film serving as the insulative film 20 was formed to cover the metal magnetic particles 10, resulting in compound magnetic particles 30. In this working example, the compound magnetic particles 30 were placed in a die for pressurizing and shaping without mixing in the organic matter 40. A pressurizing pressure of 882 MPa was used. Next, the shaped body was heat-treated for 1 hour at 300 deg C.

The temperature for the heat treatment performed on the metal magnetic particles 10 was varied in the range of at least 100 deg C. and no more than 1000 deg C., resulting in multiple shaped bodies with different sizes for the crystals 1 and the crystal grains 2. The average size of the crystals 1 was determined using the Scherrer equation described previously. Also, the size of the crystal grains 2 was determined by etching the surface of the shaped body using nital (acetate alcohol solution) and observing the surface using an optical microscope (400× zoom).

Sintering between some particles took place with 900 deg C., 1000 deg C. heat treatments, but the unsintered sections were taken out and evaluated.

Permeability for the resulting shaped bodies was measured. The average sizes of the crystals 1 and the crystal grains 2 and the permeability measurements are shown in Table 1. Permeability was measured for multiple shaped bodies with the crystals 1 having sizes of at least 100 nm, but it was not possible to make a suitable determination of the size of the crystals 1 because the resolution of the X-ray was exceeded. Therefore, the permeability measurements obtained for the shaped body were averaged and this value was entered into the field of the table corresponding to a crystal size of 110 nm.

TABLE I

| Crystal grain size 5 microns | | Crystal grain size 10 microns | | Crystal grain size 20 microns | | Heat treatment |
|---|---|---|---|---|---|---|
| Crystal size (nm) | Permeability | Crystal size (nm) | Permeability | Crystal size (nm) | Permeability | temperature (° C.) |
| 8 | 100 | 11 | 120 | 9 | 128 | 100 |
| 21 | 98 | 19 | 122 | 18 | 131 | 300 |
| 29 | 121 | 31 | 248 | 31 | 352 | 400 |
| 39 | 157 | 38 | 435 | 40 | 618 | 500 |
| 61 | 223 | 63 | 1623 | 59 | 1813 | 700 |
| 77 | 318 | 81 | 2589 | 79 | 2751 | 800 |
| 97 | 359 | 95 | 2757 | 96 | 2927 | 900 |
| 110 | 384 | 110 | 2813 | 110 | 3012 | 1000 |

Figure 4:
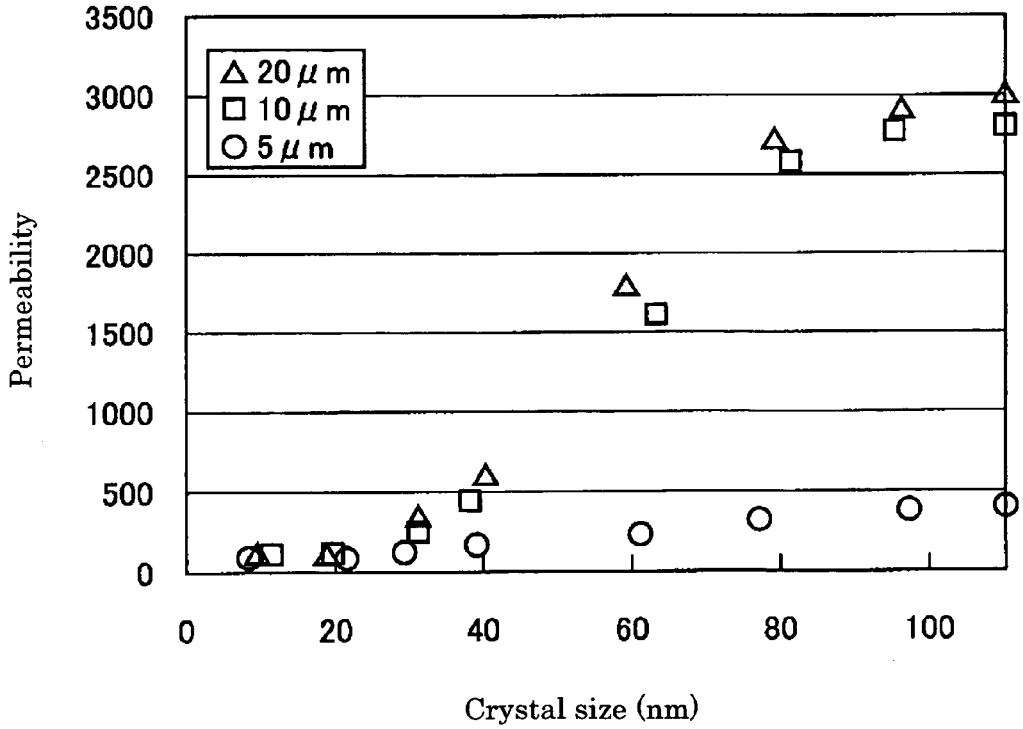
FIG. 4 is a graph showing the relationship between crystal size and permeability in this embodiment.

FIG. 4 is a graph showing the relationship between crystal size and permeability in these working examples. As FIG. 4 shows, permeability can be improved by using the size of at least 30 nm for the crystals 1. Also, this type of advantage appears especially prominently when the size of the crystal grains 2 is 10 microns and 20 microns, while the advantage was limited when the size of the crystal grains 2 was 5 microns.

The embodiment and working examples described here are, in all aspects, examples and should not be considered restrictive. The scope of the present invention is indicated not by the description above but by the scope of the claims and all modifications within the scope of the claims and within the scope of equivalence to the claims are included.

INDUSTRIAL APPLICABILITY

As described above, with the present invention, a soft magnetic material and a powder magnetic core having desired magnetic characteristics can be provided.

The invention claimed is:

1. A soft magnetic material comprising:

a metal magnetic powder, said metal magnetic powder being formed of particles, wherein:

said soft magnetic material is iron powder, each particle forming the powder is a collection of multiple crystal grains having an average size of between 10 and 20 microns, and each crystal grain includes multiple crystals having an average size, as determined by x-ray diffraction, of at least 30 nm.

2. A soft magnetic material as described in claim 1, further comprising a plurality of compound magnetic particles including said metal magnetic particles and an insulative film surrounding a surface of said metal magnetic particles.

3. A soft magnetic material as described in claim 2, further comprising an organic matter bonding said plurality of compound magnetic particles to each other.

4. A powder magnetic core made using a soft magnetic material as described in claim 1.

5. A soft magnetic material as described in claim 1, wherein said metal magnetic particles have an average crystal size of 80 nm.

6. A soft magnetic material as described in claim 2, wherein said insulative film surrounding a surface of said metal magnetic particles is between 0.005 and no more than 20 microns.

7. A soft magnetic material as described in claim 1, wherein said average crystal size is between 60 and 110 nm.

* * * * *

UNITED STATES PATENT AND TRADEMARK OFFICE

CERTIFICATE OF CORRECTION

PATENT NO. : 7,588,648 B2
APPLICATION NO. : 10/549964
DATED : September 15, 2009
INVENTOR(S) : Haruhisa Toyoda et al.

It is certified that error appears in the above-identified patent and that said Letters Patent is hereby corrected as shown below:

On the Title Page Item (73):

Please delete, "Sumitomo Electric Industries, Inc." and insert -- Sumitomo Electric Industries, Ltd. -- therefor.

Signed and Sealed this

Twenty-third Day of February, 2010

David J. Kappos

David J. Kappos
*Director of the United States Patent and Trademark Office*